US006905227B2

(12) United States Patent
Wu

(10) Patent No.: US 6,905,227 B2
(45) Date of Patent: Jun. 14, 2005

(54) LIGHT EMITTING DIODE RETROFIT MODULE FOR TRAFFIC SIGNAL LIGHTS

(75) Inventor: Chen H. Wu, Los Altos Hills, CA (US)

(73) Assignee: Leotek Electronics Corporation, Santa Clara, CA (US)

( * ) Notice: Subject to any disclaimer, the term of this patent is extended or adjusted under 35 U.S.C. 154(b) by 0 days.

(21) Appl. No.: 10/449,966

(22) Filed: May 30, 2003

(65) Prior Publication Data

US 2004/0042208 A1 Mar. 4, 2004

Related U.S. Application Data

(60) Provisional application No. 60/408,260, filed on Sep. 4, 2002.

(51) Int. Cl.[7] ..... F21V 1/00; F21V 11/00

(52) U.S. Cl. ..... 362/240; 362/243; 362/249; 362/268; 362/800; 362/242; 362/244; 362/331; 362/245; 362/545; 362/329; 362/226

(58) Field of Search ..... 362/240, 235, 362/243, 249, 268, 361, 800, 227, 236, 242, 244, 331, 245, 545, 329, 226; 439/168, 336, 419; 116/63 R, 63 P

(56) References Cited

U.S. PATENT DOCUMENTS

| | | | | |
|---|---|---|---|---|
| 1,539,090 A | * | 5/1925 | King | 362/308 |
| 3,851,165 A | * | 11/1974 | Beck et al. | 362/268 |
| 3,981,263 A | * | 9/1976 | Capucio | 116/63 P |
| 4,298,869 A | | 11/1981 | Okuno | |
| 4,384,271 A | | 5/1983 | Visser | |
| 5,365,418 A | | 11/1994 | Gardner | |
| 5,416,679 A | | 5/1995 | Ruskouski et al. | |
| 5,561,346 A | | 10/1996 | Byrne | |
| D385,051 S | | 10/1997 | Wu | |
| 5,775,801 A | | 7/1998 | Shaffer | |
| 5,806,965 A | | 9/1998 | Deese | |
| 5,833,355 A | | 11/1998 | You et al. | |
| 5,947,587 A | * | 9/1999 | Keuper et al. | 362/235 |
| 5,949,347 A | | 9/1999 | Wu | |
| 6,036,336 A | | 3/2000 | Wu | |
| D424,715 S | | 5/2000 | Wu | |
| 6,244,732 B1 | | 6/2001 | Futami et al. | |
| 6,268,801 B1 | | 7/2001 | Wu | |
| 6,283,613 B1 | * | 9/2001 | Schaffer | 362/245 |
| 6,439,743 B1 | | 8/2002 | Hutchison | |
| 6,502,956 B1 | | 1/2003 | Wu | |
| 6,513,950 B1 | | 2/2003 | Ono | |

(Continued)

OTHER PUBLICATIONS

U.S. Appl. No. 10/449,944, filed May 2003, Wu et al.
Leotek Brochure (1992).
Leotek Brochure (1996).
WACO Brocure (1999).
Dialight Brochure (1999).

*Primary Examiner*—Sandra O'Shea
*Assistant Examiner*—Sharon Payne
(74) *Attorney, Agent, or Firm*—DLA Piper Rudnick Gray Cary US LLP

(57) ABSTRACT

A high power LED lamp module for installation in conventional traffic signal lamps includes a housing with a side flange and a spacer ring extending therefrom, a plurality of LEDs disposed inside the housing for producing diverging light, a power supply disposed in the housing between the LEDs and the housing rear wall, a threaded electrical connector extending therefrom, and Fresnel/outer lenses extending across the open end of the spacer ring for collimating the diverging light from the LEDs. The Fresnel lens is disposed a first distance from the light emitting diodes wherein the light collimated thereby just fills and illuminates the entire outer lens. The flange is separated from the rear wall portion by a second distance that does not exceed about 100 mm or about 70mm for a 12 or 8 inch diameter lamp module respectively, to ensure the lamp module fits inside conventional traffic signal lamps.

22 Claims, 5 Drawing Sheets

U.S. PATENT DOCUMENTS 6,558,021 B2 5/2003 Wu et al.
6,614,358 B1 9/2003 Hutchison et al.
6,616,299 B2 9/2003 Martineau
6,761,471 B2 7/2004 Wu
2003/0123254 A1 * 7/2003 Brass et al. ..... 362/231
2003/0185005 A1 * 10/2003 Sommers et al. ..... 362/240

* cited by examiner

LIGHT EMITTING DIODE RETROFIT MODULE FOR TRAFFIC SIGNAL LIGHTS

This application claims the benefit of U.S. Provisional Application No. 60/408,260, filed Sep. 4, 2002, and entitled Light-Emitting Diode (LED) Retrofit Module For Traffic Signal Lights.

FIELD OF THE INVENTION

The present invention relates to Light-Emitting Diode (LED) lamps for traffic signal lamps, and more particularly to an improved retrofit LED lamp module and method for replacing conventional light bulbs in traffic signal lamps with the improved retrofit LED lamp module, including 12 and 8 inch round traffic signal lamps, pedestrian signs, hand signs, arrow signs and signs with messages.

BACKGROUND OF THE INVENTION

Light emitting diode (LED) lamps have been developed to replace conventional incandescent or fluorescent lamps for reducing electrical and maintenance costs, and for increasing reliability. LED lamps consume less electrical energy than conventional lamps while exhibiting much longer lifetimes. Such LED lamps typically include a power supply and a plurality of LEDs mounted on a flat or curved surface.

One growing use of LED lamps is the replacement of incandescent light bulbs in traffic signal lamps. A common conventional traffic signal lamp is illustrated in FIGS. 1A and 1B, and includes a housing 1, a front door plate 2, a lens 3, a reflector 4 and an incandescent light bulb 5. Retainers 6 affix the lens 3 to the front door plate 2, which opens via hinges 7 to allow access to the interior of the housing 1. Light bulb 5 screws into threaded electrical socket 8, which is electrically attached to a terminal strip 9, which in turn receives its power from the traffic signal controller.

It is known to replace the incandescent light bulb 5 with an LED lamp, along with the lens 3 since the lens may be designed specifically for the output of an incandescent light bulb. In a conventional traffic signal lamp retrofit procedure, the lens 3, light bulb 5, reflector 4 and socket 8 are all removed, and an LED lamp module 10 is installed onto the front door plate 2 to replace lens 3, as illustrated in FIG. 2. Wires 11 from the LED lamp module are connected to the terminal strip 9. The lamp module 10 includes up to several hundred LEDs all mounted on a flat printed circuit board and are evenly distributed across the lens area.

The above mentioned retrofit method has several drawbacks. First, it is time consuming and labor intensive to remove the reflector and socket, and access the terminal strip with new wiring. Because traffic is usually blocked in order to access traffic lights, time is of the essence. Second, in order to safely disconnect the socket connector wires from the terminal strip, and connect new wires from the LED lamp module to the terminal strip, the power to the traffic signal must be temporarily turned off, which disrupts traffic flow through the intersection. Finally, once the retrofit is complete, it is not possible to put the original incandescent lamp back in the traffic signal lamp, for example, in case a spare LED lamp module is not available.

U.S. Pat. No. 6,268,801, which is incorporated herein by reference, discloses a method and apparatus for retrofitting traffic signal lamps with LED modules, without having to remove the reflector 4 and socket connector 8, and without having to access the terminal strip with new wiring. The LED module disclosed in this patent includes a plurality of light emitting diodes evenly distributed on a flat PC board, a power supply electrically connected to the plurality of light emitting diodes, and wires extending from the power supply that terminate in a threaded electrical connector compatible with the socket connector 8. The method of retrofitting the traffic signal lamp includes removing the lens from the front door plate, removing the threaded light bulb from the socket connector, affixing the LED lamp module to the front door plate, and connecting the threaded electrical connector of the LED lamp module to the socket connector. This retrofit procedure is simple, takes very little time and labor, and can be safely performed without turning power off to the traffic signal lamp. Typical traffic signal lamps have lenses that are 8 or 12 inches in diameter. As long as the outer rim of LED lamp module has a similar shape and diameter as the outer rim of lens, then the same retainers that secured the lens in place onto the front door plate can be used to secure the LED lamp module in place. Thus, the LED lamp module preferably has a flange that is shaped and sized to match the outer rim of the lens that it replaces.

It is also well known in the art to make LED lamps by mounting a plurality of outwardly facing LEDs to a spherical lamp head, which terminates with a threaded electrical connector. Such an LED lamp simulates the light distribution of a standard light bulb, except the light is generated by the outwardly facing LEDs instead of an internal filament. This LED lamp can be easily substituted for a conventional traffic light bulb, but the intensity from such a lamp can be problematic. Not only is it difficult to mount enough LEDs on the spherical lamp head to produce the desired luminosity, but light emanating therefrom must still reflect off of the reflector, which can be optically lossy and degrade over time. The traffic light lens may also have to be replaced to produce the desired illumination pattern.

Recently, more efficient and higher power LEDs have been developed that reduce the number of LEDs which are necessary to meet signal lamp output intensity requirements (e.g. can be as few as 2 for some applications). For example, Dialight Corporation (of Farmingdale, N.J.) markets an LED module 12 (shown in FIG. 3) containing only 18 high power LEDs 14, which provide as much light output as a conventional 80–300 LED array on a 12 inch diameter circuit board. To provide an aesthetically acceptable appearance, the Dialight LED module has all 18 LEDs 14 mounted together in a concentrated small cluster on the rear wall 15 of the module's housing 13. A planar Fresnel lens 16 and curved outer lens 17 are both mounted to the flange 18 that engages with the front door plate of the traffic signal lamp housing. The Fresnel lens 16 collimates the diverging light output to evenly illuminate the outer lens 17. Wires 19 extend from the LED module for connection to the traffic signal lamp's terminal strip.

In order to fully illuminate the Fresnel/outer lenses 16/17, the LEDs 14 must be placed a minimum distance $D_1$ behind the Fresnel lens. For a 12 inch diameter module, even with the LEDs placed at the very rear of the module, the distance $D_2$ between the front surface of the flange 18 and the rear wall 15 still exceeds approximately 109 mm ($D_2$ for 8 inch diameter module exceeds approximately 102 mm). Moreover, since there is no room behind the LEDs for the module's power supply 20, the housing sidewall must extend laterally far enough to accommodate the module's power supply 20 so that it does not block the light emitted by the LEDs from reaching the lenses 16/17. Since most conventional 12 inch diameter traffic signal lamps have a depth of approximately 112 mm ±2 mm (measured from the back surface of the door plate 2 to the bottom of reflector 4 or to the socket connector 8 should it protrude up from the reflector bottom) and most conventional 8 inch diameter traffic signal lamps have a depth of approximately 80 mm ±2 mm, and a spherical or parabolic shape that is narrower than the profile of the Dialight lamps, the depth and shape of these lamps simply prevents it from fitting inside conventional traffic lamp reflectors. Thus, the installation of the Dialight lamp is cumbersome and time consuming because it requires removal of the existing traffic signal lamp reflector, electrical socket, and electrical connection to the terminal strip.

There is a need for a high power LED lamp module that fits inside a conventional traffic signal lamp reflector, and which facilitates a fast and simple retrofit thereof without having to turn off power thereto.

SUMMARY OF THE INVENTION

The present invention solves the aforementioned problems by providing an LED lamp module that conveniently installs into conventional traffic signal lamps without having to remove the reflector and electrical socket connector therein.

The LED lamp module of the present invention includes a housing, a plurality of LEDs, a power supply, wires, a Fresnel lens, and an outer lens. The housing includes a rear wall portion, a side wall portion extending from the rear wall portion, a flange extending from the side wall portion and having a front surface that defines a flange plane, and a spacer ring portion extending from the flange by a height H and terminating with an open end. The plurality of LEDs are disposed inside the housing for producing diverging light. The power supply is disposed in the housing between the plurality of LEDs and the rear wall portion, and are electrically connected to the plurality of light emitting diodes. The wires are connected to the power supply and extend from the housing and terminate in a threaded electrical connector. The Fresnel lens extends across the open end for collimating the diverging light from the LEDs. The outer lens disposed over the Fresnel lens for receiving the collimated light, wherein the Fresnel lens is disposed a first distance from the light emitting diodes so that the collimated light just fills and illuminates the entire outer lens.

In another aspect of the present invention, the LED lamp module includes a housing, a plurality of LEDs, a power supply, wires, a Fresnel lens, and an outer lens. The housing includes a rear wall portion, a side wall portion extending from the rear wall portion, a flange extending from the side wall portion and having a front surface that defines a flange plane, and a spacer ring portion extending from the flange by a height H and terminating with an open end. The plurality of LEDs are disposed inside the housing for producing diverging light. The power supply is disposed in the housing and electrically connected to the plurality of light emitting diodes. The wires are connected to the power supply and extend from the housing and terminate in a threaded electrical connector. The Fresnel lens is curved and extends across the open end for collimating the diverging light from the LEDs. The outer lens is planar and is disposed over the Fresnel lens for receiving the collimated light. The Fresnel lens is disposed a first distance from the light emitting diodes so that the collimated light just fills and illuminates the entire outer lens.

In yet one more aspect of the present invention, the LED lamp module includes a housing, a plurality of LEDs, a power supply, wires, a Fresnel lens, and an outer lens. The housing includes a rear wall portion, a side wall portion extending from the rear wall portion, a flange extending from the side wall portion and having a front surface that defines a flange plane, and a spacer ring portion extending from the flange by a height H and terminating with an open end. The plurality of LEDs are disposed inside the housing for producing diverging light. The power supply is disposed in the housing between the LEDs and the rear wall portion, and is electrically connected to the plurality of light emitting diodes. The wires are connected to the power supply and extend from the housing and terminate in a threaded electrical connector. The Fresnel lens is curved and extends across the open end for collimating the diverging light from the LEDs. The outer lens is planer and is disposed over the Fresnel lens for receiving the collimated light. The Fresnel lens is disposed a first distance from the light emitting diodes so that the collimated light just fills and illuminates the entire outer lens. The outer lens has a diameter of about 8 or 12 inches, wherein the spacer ring portion height H is selected such that the flange plane is separated from the rear wall portion by a second distance that does not exceed about 70 mm if the outer lens diameter is about 8 inches and about 100 mm if the outer lens diameter is about 12 inches.

Other objects and features of the present invention will become apparent by a review of the specification, claims and appended figures.

DETAILED DESCRIPTION OF THE PREFERRED EMBODIMENTS

The present invention is an LED lamp module utilizing high power LEDs that is ideal for installation in conventional traffic signal lamps.

Figure 4:
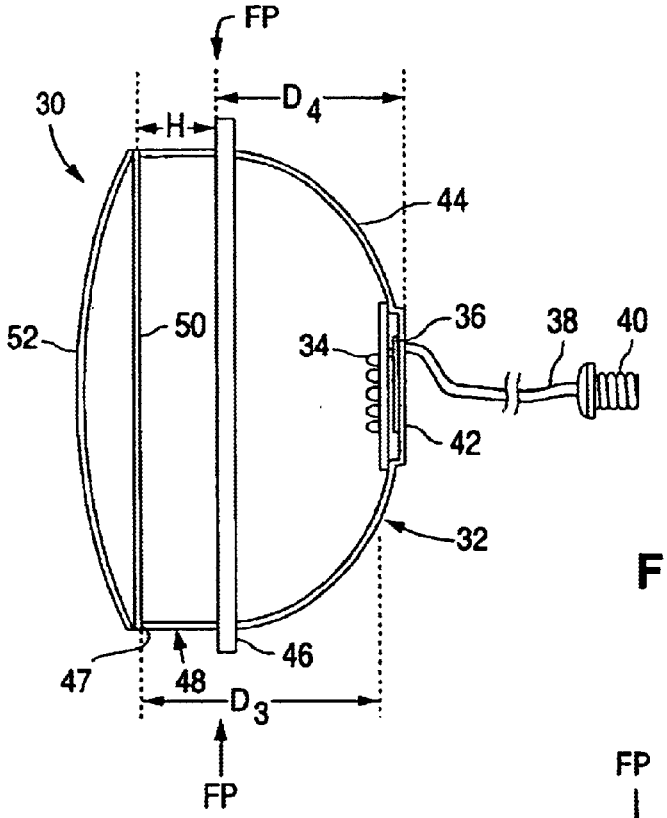
FIG. 4 is a side cross-sectional view of the high power LED lamp module of the present invention.

A high power LED lamp module 30 according to the present invention is illustrated in FIG. 4, and includes a housing 32, a plurality of high power LEDs 34 disposed in the housing 32, a power supply 36 disposed in the housing and behind the LEDs 34 for supplying electrical power thereto, and electrical wires 38 that are connected to the power supply 36 at one end and terminate in a threaded electrical connector 40 at the other end. The housing includes a rear wall portion 42 on which the power supply 36 and LEDs 34 are mounted, a sidewall portion 44, a flange 46 extending out from the sidewall portion 44, and a spacer ring portion 48 extending from the flange 46 by a predetermined height H and terminating in an open end 47. A Fresnel lens 50 and outer lens 52 are mounted over the spacer ring portion open end 47. The housing sidewall portion 44 has a rounded (spherical) or parabolic shape similar to that of conventional traffic signal lamp reflectors.

Figure 3:
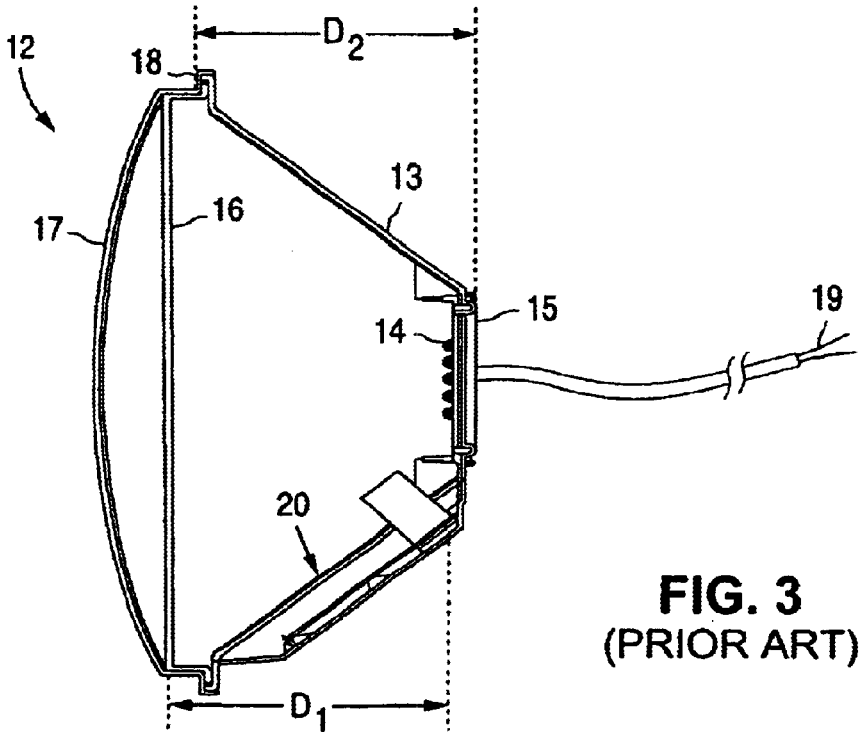
FIG. 3 (PRIOR ART)
FIG. 3 is a side cross-sectional view of a conventional high power LED lamp module.

The Fresnel lens 50 is separated from the high power LEDs 34 by a distance $D_3$ such that the diverging light from the LEDs 34 is collimated by the Fresnel lens 50 and just fills and illuminates the entire outer lens 52. For a 12 inch diameter module 30, the distance $D_4$ between the front surface of flange 46 (which defines a flange plane FP) and the rear wall portion 42 can be as low as about 80 mm, which is significantly less than distance $D_2$ (~109 mm) shown in FIG. 3, primarily because of the height H of spacer ring portion 48 which positions Fresnel/outer lenses 50/52 further away from the LEDs 34. Likewise, for an 8 inch diameter module 30, the distance $D_4$ can be as low as about 58 mm. The reduced distance $D_4$ provides sufficient space inside the housing to position the power supply 36 behind the LEDs 34 where it cannot block any light. The reduced distance $D_4$, coupled with the rounded or parabolic shape of sidewall portion 44, allows the module 30 to be mounted in a standard traffic signal lamp without removing its reflector, its threaded electrical socket connector, and the electrical connection to the terminal strip, while still providing plenty of space for the electrical connection therebetween using connector 40. It has been found that the module 30, with its electrical connector 40, can be reliably retrofitted into most 12 inch diameter conventional traffic signal lamps so long as distance $D_4$ does not exceed about 100 mm, and into most 8 inch diameter conventional traffic signal lamps so long as distance $D_4$ does not exceed about 70 mm.

Figure 5:
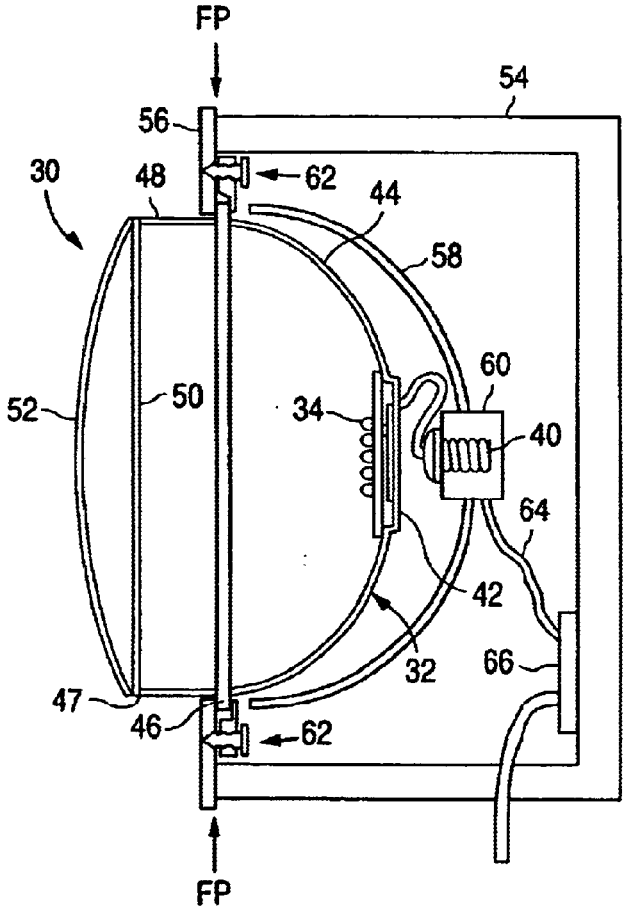
FIG. 5 is a side cross-sectional view of a traffic signal lamp retro-fitted with the high power LED lamp module of the present invention.

The retro-fitted traffic signal lamp according to the present invention is illustrated in FIG. 5, and includes a signal lamp housing 54, a front door plate 56, a reflector 58 and a threaded socket connector 60. Retainers 62 mount the front surface of flange 46 of the LED lamp module 30 against the front door plate 56, which opens via hinges to allow access to the interior of the signal lamp housing 54. The threaded electrical connector 40 screws into socket connector 60. Wires 64 connect socket connector 60 to a terminal strip 66, which receives its power from the traffic signal controller. The spacer ring portion 48 of housing 32 extends through front door plate 56, with the height H selected to maintain the proper distance $D_3$ between the LEDs 34 and the Fresnel lens 50 for proper illumination of the outer lens 52.

Figure 1A:
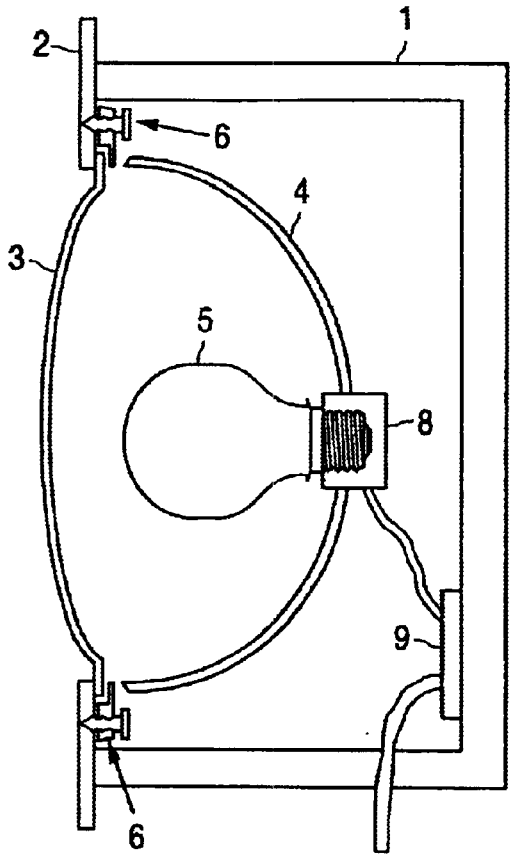
FIG. 1A (PRIOR ART)
FIG. 1A is a side cross-sectional view of a conventional traffic signal lamp.
Figure 1B:
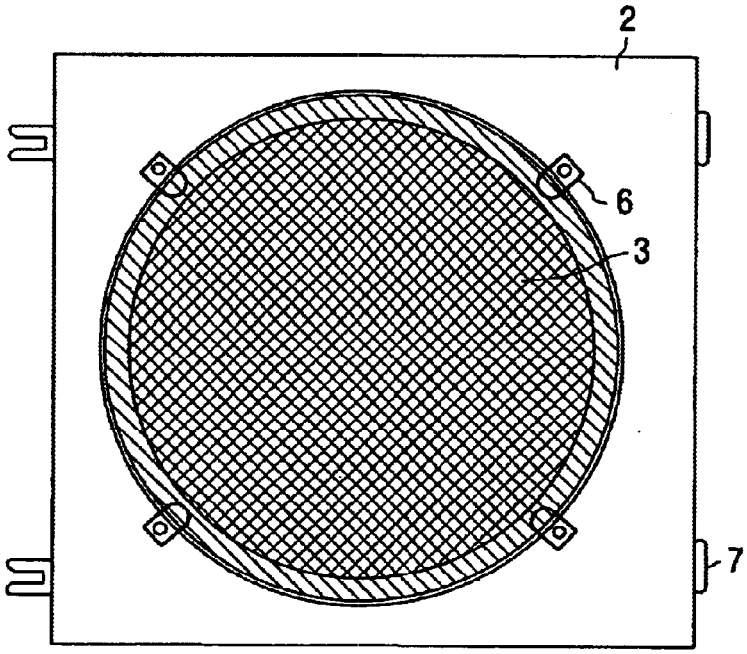
FIG. 1B (PRIOR ART)
FIG. 1B is a back view of the front door from a conventional traffic signal lamp.
Figure 2:
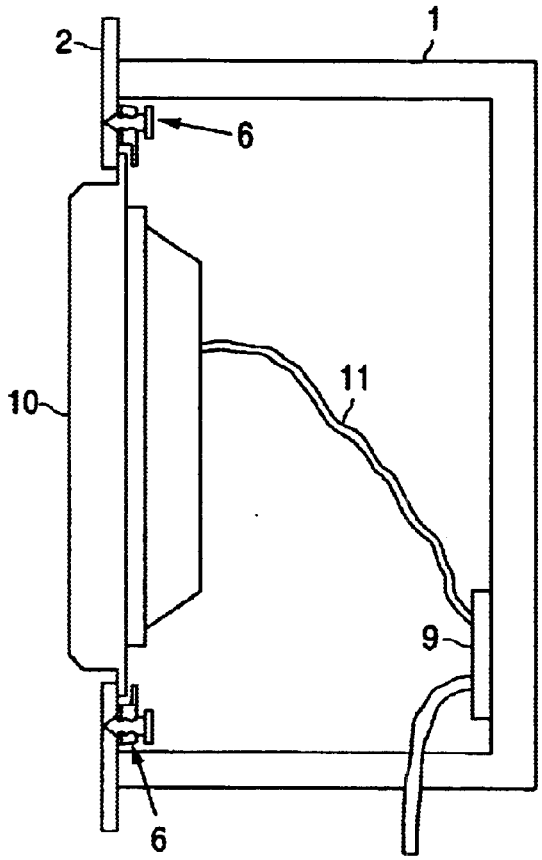
FIG. 2 (PRIOR ART)
FIG. 2 is a side cross-sectional view of a conventional traffic signal lamp containing a conventional LED lamp module.

In order to retrofit the conventional traffic signal lamp of FIG. 1 with the LED lamp module 60 as shown in FIG. 4, the front door plate 56 is rotated open to expose the inside of traffic signal lamp housing 54. Retainers 62 are loosened, and lens 3 is removed. Flange 46, which preferably has the same outer circumference and shape as the lens 3, is affixed to the front door plate 56 by the retainers 62. The incandescent light bulb 5 is unscrewed out of the existing socket connector 60, and threaded electrical connector 40 is screwed into socket connector 60. Then, the front door plate 56 is closed.

For many traffic signal lamp applications, a non-symmetrical radiation pattern therefrom may be desired. For example, if the traffic signal lamp is located over a roadway, the majority of the light output should be directed straight out of the lamp, and/or slightly downward, toward the traffic. Thus, the positioning of the LED's, and/or the lenses 50/52 used therewith, can produce an asymmetrical lamp output. If this is the case, then the lamp housing 32 and/or the lenses 50/52 can be rotated before the retainers 62 are tightened, to produce the desired non-symmetrical radiation output pattern.

This retrofit procedure is simple, takes very little time and labor, and can be safely performed without turning power off to the traffic signal lamp. Typical traffic signal lamps have lenses that are 8 or 12 inches in diameter. As long as the flange 46 of LED lamp module 30 has a comparable shape and diameter as the outer rim of lens 3, then the same retainers 62 that secured the lens 3 in place on the front door plate 56 can be used to secure the LED lamp module 30 in place. It is possible to re-use the lens 3 removed from the front door plate as the outer lens 52 of the lamp module 30. A spacer can be used around flange 46 to match the flange size with that required by retainers 62.

Figure 6:
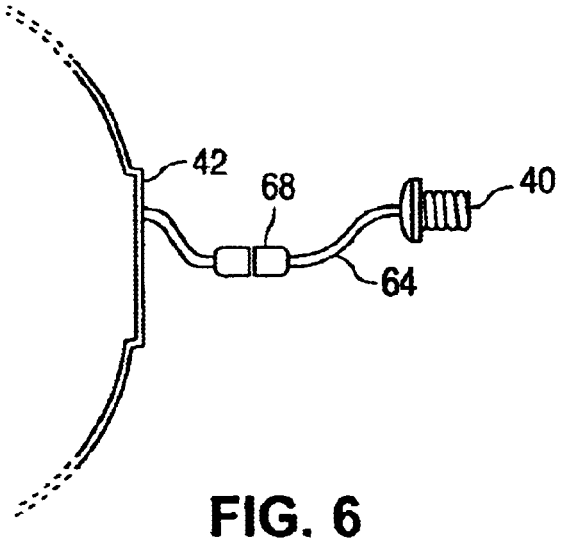
FIG. 6 is a partial side view of the high power LED lamp module of the present invention, with a removable electrical connector disposed along its electrical wires.
Figure 7:
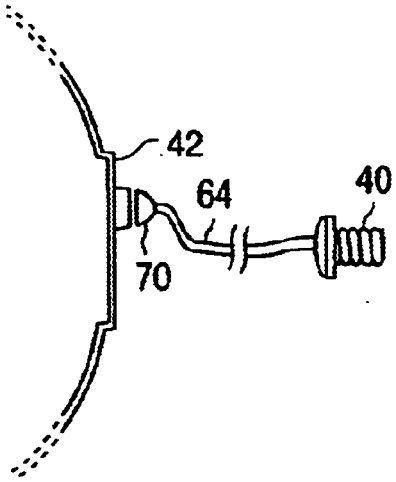
FIG. 7 is a partial side view of the high power LED lamp module of the present invention, with a removable electrical connector disposed at the housing rear wall.
Figure 8:
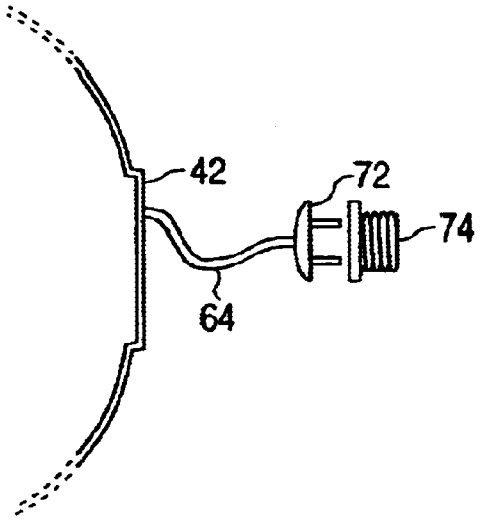
FIG. 8 is a partial side view of the high power LED lamp module of the present invention, where the threaded electrical connector includes a pronged plug and a threaded adapter.

FIGS. 6–8 show alternate embodiments of the LED lamp module 30 of the present invention. FIG. 6 illustrates a removable electrical connector 68 on wires 64 to facilitate screwing in threaded connector 40 into socket connector 60. FIG. 7 illustrates a removable connector 70 mounted to the LED module housing 32 that connects to wires 64. FIG. 8 illustrates that the threaded connector 40 comprises a pronged plug 72 and a threaded adapter 74. The threaded adapter 74 screws into the socket connector 60, and the pronged plug 72 plugs into the adapter 74.

Figure 9:
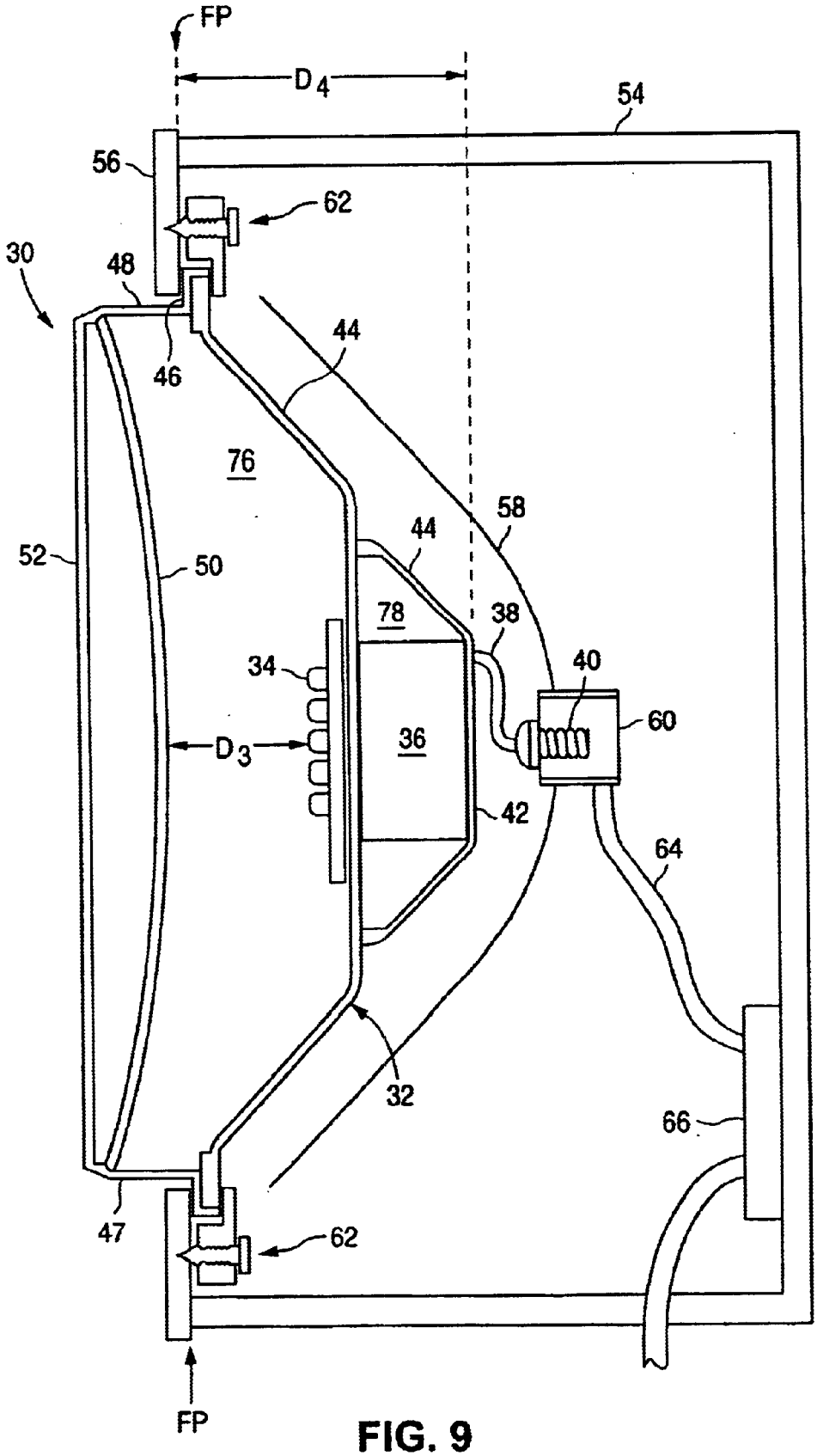
FIG. 9 is a side cross-sectional view of a traffic signal lamp retro-fitted with the high power LED lamp module of the present invention, where the Fresnel lens is curved and the outer lens is flat.

FIG. 9 illustrates another alternate embodiment of the LED lamp module 30, which is shown mounted in a standard traffic signal lamp with a reflector 58 having more of a parabolic shape. With this embodiment, the Fresnel lens 50 is curved (concave) and the outer lens 52 is flat, which reduces the minimum distance $D_3$ between the LEDs 34 and the Fresnel lens 50 necessary to just fill and illuminate the entire outer lens 52 with the light from the LEDs 34. By reducing distance $D_3$ with a curved Fresnel lens, there is more room for the power supply, and/or the distance $D_4$ between the flange plane FP (defined by the front surface of flange 46) and the rear wall 42 can be reduced as well. The housing 32 divides the lamp module 30 into two compartments: an LED compartment 76 (containing the LEDs 34) and a power supply compartment 78 (containing the power supply 36). The sidewall portion 44 of the LED lamp module 30 conforms with the parabolic shape of the reflector 58.

The present invention allows for the retrofit of a conventional traffic signal lamp (with the lamp module 30 of the present invention) in less than 5 minutes, as compared to installation times exceeding 20 minutes where the reflector and socket connectors must be removed. The advantages of the present invention include: 1) using more efficient and fewer high power LEDs, 2) reducing installation times (which saves installation costs and reduces traffic interruption), and 3) eliminating the need for removal and disposal of reflectors and socket connectors from traffic signal lamps.

It is to be understood that the present invention is not limited to the embodiment(s) described above and illustrated herein, but encompasses any and all variations falling within the scope of the appended claims. For example, part or all of the reflector 26 could be removed during the retrofitting process, so long as the socket electrical connector stays intact, to benefit from the threaded electrical connector 40.

In fact, the reflector 26 and the socket electrical connector could be removed entirely, and the module 30 directly hardwired to the terminal strip 66. Further, the method of the present invention applies to any lamp that utilized a conventional threaded light bulb with a lens mounted thereover. One in the art will appreciate that the collimated light exiting the Fresnel lens is not perfectly collimated light, but rather is simply less divergent than the light entering the Fresnel lens. Lastly, while FIGS. 4 and 9 show one of the Fresnel and outer lenses 50/52 as being planar with the other as being curved, it is possible that both lenses are planar, or both lenses are curved.

What is claimed is:

1. An LED lamp module, comprising:

a housing that includes:

a rear wall portion, a side wall portion extending from the rear wall portion, a flange extending from the side wall portion and having a front surface that defines a flange plane, and a spacer ring portion extending from the flange by a height H and terminating with an open end;

a plurality of LEDs disposed inside the housing for producing diverging light;

a power supply disposed in the housing between the plurality of LEDs and the rear wall portion, and electrically connected to the plurality of light emitting diodes;

wires connected to the power supply, the wires extending from the housing and terminating in a threaded electrical connector;

a Fresnel lens extending across the open end for collimating the diverging light from the LEDs; and an outer lens disposed over the Fresnel lens for receiving the collimated light, wherein the Fresnel lens is disposed a first distance from the light emitting diodes so that the collimated light just fills and illuminates the entire outer lens.

2. The LED lamp module of claim 1, wherein the outer lens has a diameter of about 12 inches, and wherein the spacer ring portion height H is selected such that the flange plane is separated from the rear wall portion by a second distance that does not exceed about 100 mm.

3. The LED lamp module of claim 1, wherein the outer lens has a diameter of about 8 inches, and wherein the spacer ring portion height H is selected such that the flange plane is separated from the rear wall portion by a second distance that does not exceed about 70 mm.

4. The LED lamp module of claim 1, wherein the threaded electrical connector comprises:

a plug having prongs at which the wires terminate; and a socket adapter having threads at one end and receptacles for plug prongs in another end;

wherein the prongs plug into the receptacles of the socket adapter.

5. The LED lamp module of claim 1, wherein the wires further include a removable electrical connector at a point along a length thereof.

6. The LED lamp module of claim 1, wherein the wires are removably connected to the power supply by a removable electrical connector.

7. The LED lamp module of claim 1, wherein the sidewall portion has a substantially spherical shape.

8. The LED lamp module of claim 1, wherein the sidewall portion has a substantially parabolic shape.

9. The LED lamp module of claim 1, wherein the housing is divided into first and second compartments, with the LEDs disposed in the first compartment and the power supply disposed in the second compartment.

10. The LED lamp module of claim 1, wherein the Fresnel lens is curved and the outer lens is planar.

11. The LED lamp module of claim 1, wherein the Fresnel lens is planar and the outer lens is curved.

12. An LED lamp module, comprising:

a housing that includes:

a rear wall portion, a side wall portion extending from the rear wall portion, a flange extending from the side wall portion and having a front surface that defines a flange plane, and a spacer ring portion extending from the flange by a height H and terminating with an open end;

a plurality of LEDs disposed inside the housing for producing diverging light;

a power supply disposed in the housing and electrically connected to the plurality of light emitting diodes;

wires connected to the power supply, the wires extending from the housing and terminating in a threaded electrical connector;

a curved Fresnel lens extending across the open end for collimating the diverging light from the LEDs; and a planar outer lens disposed over the Fresnel lens for receiving the collimated light, wherein the Fresnel lens is disposed a first distance from the light emitting diodes so that the collimated light just fills and illuminates the entire outer lens.

13. The LED lamp module of claim 12, wherein the outer lens has a diameter of about 12 inches, and wherein the spacer ring portion height H is selected such that the flange plane is separated from the rear wall portion by a second distance that does not exceed about 100 mm.

14. The LED lamp module of claim 12, wherein the outer lens has a diameter of about 8 inches, and wherein the spacer ring portion height H is selected such that the flange plane is separated from the rear wall portion by a second distance that does not exceed about 70 mm.

15. The LED lamp module of claim 12, wherein the power supply is disposed between the LEDs and the rear wall portion.

16. The LED lamp module of claim 12, wherein the threaded electrical connector comprises:

a plug having prongs at which the wires terminate; and a socket adapter having threads at one end and receptacles for plug prongs in another end;

wherein the prongs plug into the receptacles of the socket adapter.

17. The LED lamp module of claim 12, wherein the wires further include a removable electrical connector at a point along a length thereof.

18. The LED lamp module of claim 12, wherein the wires are removably connected to the power supply by a removable electrical connector.

19. The LED lamp module of claim 12, wherein the sidewall portion has a substantially spherical shape.

20. The LED lamp module of claim 12, wherein the sidewall portion has a substantially parabolic shape.

21. The LED lamp module of claim 12, wherein the housing is divided into first and second compartments, with the LEDs disposed in the first compartment and the power supply disposed in the second compartment.

22. An LED lamp module, comprising:

a housing that includes:

a rear wall portion, a side wall portion extending from the rear wall portion, a flange extending from the side wall portion and having a front surface that defines a flange plane, and a spacer ring portion extending from the flange by a height H and terminating with an open end;

a plurality of LEDs disposed inside the housing for producing diverging light;

a power supply disposed in the housing between the LEDs and the rear wall portion, and electrically connected to the plurality of light emitting diodes;

wires connected to the power supply, the wires extending from the housing and terminating in a threaded electrical connector;

a curved Fresnel lens extending across the open end for collimating the diverging light from the LEDs; and a planar outer lens disposed over the Fresnel lens for receiving the collimated light, wherein the Fresnel lens is disposed a first distance from the light emitting diodes so that the collimated light just fills and illuminates the entire outer lens;

wherein the outer lens has a diameter of about 8 or 12 inches, and wherein the spacer ring portion height H is selected such that the flange plane is separated from the rear wall portion by a second distance that does not exceed about 70 mm if the outer lens diameter is about 8 inches and about 100 mm if the outer lens diameter is about 12 inches.

* * * * *